US006729566B2

(12) United States Patent
Giesedieck et al.

(10) Patent No.: US 6,729,566 B2
(45) Date of Patent: May 4, 2004

(54) MULTI-SIDED SHAFT FOR A CRUSHER

(75) Inventors: Chris Giesedieck, St. Louis, MO (US); Fred Epplin, Ashley, IL (US)

(73) Assignee: American Pulverizer Co., Mo. Corp., St. Louis, MO (US)

( * ) Notice: Subject to any disclaimer, the term of this patent is extended or adjusted under 35 U.S.C. 154(b) by 0 days.

(21) Appl. No.: 10/120,709

(22) Filed: Apr. 11, 2002

(65) Prior Publication Data

US 2003/0047628 A1 Mar. 13, 2003

Related U.S. Application Data

(60) Provisional application No. 60/284,096, filed on Apr. 17, 2001.

(51) Int. Cl.[7] ..... B02C 13/284
(52) U.S. Cl. ..... 241/73; 241/194
(58) Field of Search ..... 241/73, 194, 195, 241/189.1

(56) References Cited

U.S. PATENT DOCUMENTS 4,009,836 A * 3/1977 Strom et al. ..... 241/73
4,690,340 A * 9/1987 Hatanaka ..... 241/236
5,381,972 A * 1/1995 Chon et al. ..... 241/73
5,454,522 A * 10/1995 Ballu ..... 241/237
5,697,562 A * 12/1997 Leblond ..... 241/101.74
6,234,414 B1 * 5/2001 DeVitis et al. ..... 241/30
6,527,210 B1 * 3/2003 Mecklenfeld ..... 241/194

FOREIGN PATENT DOCUMENTS

JP 08164344 A * 6/1996 ..... B02C/18/40

* cited by examiner

*Primary Examiner*—Mark Rosenbaum
*Assistant Examiner*—Jimmy Nguyen
(74) *Attorney, Agent, or Firm*—Paul M. Denk

(57) ABSTRACT

A shredder, crusher, hammer mill, ring mill or the like is provided with a multi-sided rotor shaft to which spider arms and hammers are mounted. The rotor shaft has at least one pair, and preferably two or more pairs, of opposing sides. The hammers are pivotally mounted between spider arms. The spider arms have bases which include openings. The spider arm base openings have straight sides corresponding to the number of straight sides on the rotor shaft. The spider arm straight sides engage the rotor shaft straight sides. Hence, the spider arms are rotationally fixed in place relative to the rotor shaft without the use of keys and keyways, pins, bolts, or other types of fasteners, allowing for easier assembly and reduced maintenance costs for the crusher.

3 Claims, 3 Drawing Sheets

MULTI-SIDED SHAFT FOR A CRUSHER

CROSS REFERENCE TO RELATED ADPLICATION

This application is a non-provisional application claiming priority upon the provisional application having Ser. No.: 60/284,096, filed on Apr. 17, 2001.

BACKGROUND OF THE INVENTION

Crushers, shredders, hammer mills, ring mills, and the like, are often used to process scrap material and stone, to crush or reduce the size of the material so that it can more easily be handled by other equipment for further processing or use.

Such crushers typically include a plurality of hammers mounted about a rotatable shaft. As the shaft rotates, the hammers engage and crush whatever media is introduced into the crusher. The hammers can be mounted between spiders which are positionally fixed relative to the rotor shaft. Typically, the rotor shaft is cylindrical. The use of a cylindrical shaft requires that the spider arms be positively keyed to the shaft, for example, using a square or rectangular key on the spider and a corresponding keyway on the shaft, so that the spider arms cannot rotate relative to the shaft. The use of a keyway weakens the main shaft and makes removal of the spiders and end discs a much more difficult task. Further, the key will weaken over time, and eventually the rotor assembly will shift between the shredder housings. Obviously, this can necessitate a repair of the crusher, requiring that operation of the crusher be stopped for the duration of the repair. Depending on the location of the spider which is no longer positively fixed with respect to the shaft, the crusher can be shut down for a considerable period of time.

BRIEF SUMMARY OF THE INVENTION

A shredder, crusher, hammermill, ringmill or the like is provided with a multi-sided rotor shaft to which spider arms and hammers are mounted. The rotor shaft has at least at least one pair, and preferably two or more pairs, of opposing sides. The hammers are pivotally mounted between spider arms. The spider arms have bases which include openings. The spider arm base openings have straight sides corresponding to the number of straight sides on the rotor shaft. The spider arm straight sides engage the rotor shaft straight sides. Hence, the spider arms are rotationally fixed in place relative to the rotor shaft without the of a central key, or other types of fasteners, allowing for easier assembly and reduced maintenance costs for the shredder.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes what I presently believe is the best mode of carrying out the invention.

Figure 1:
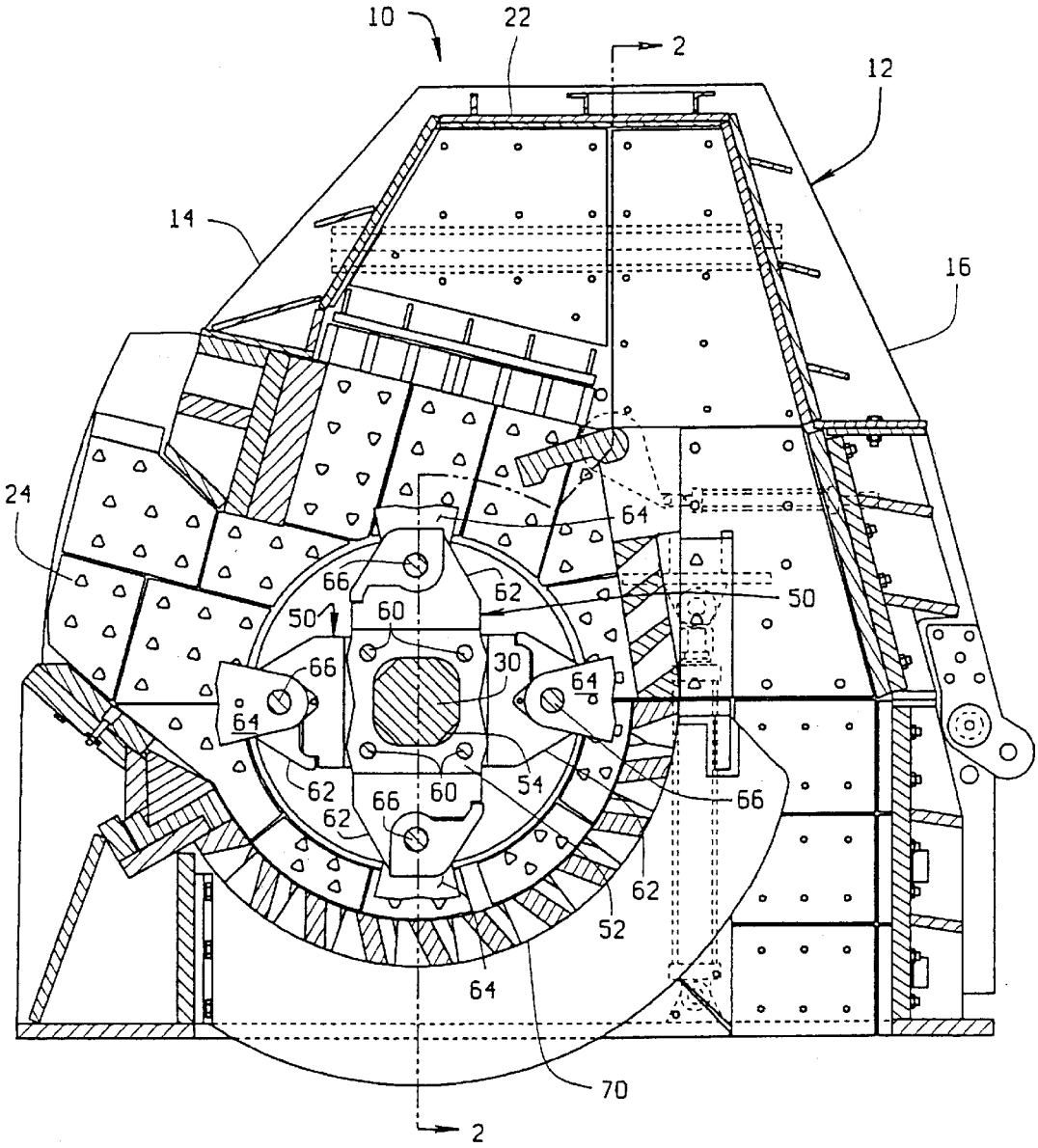
FIG. 1 is a cross-sectional view of a crusher having a shaft of the present invention taken along line 1—1 of FIG. 2.
Figure 2:
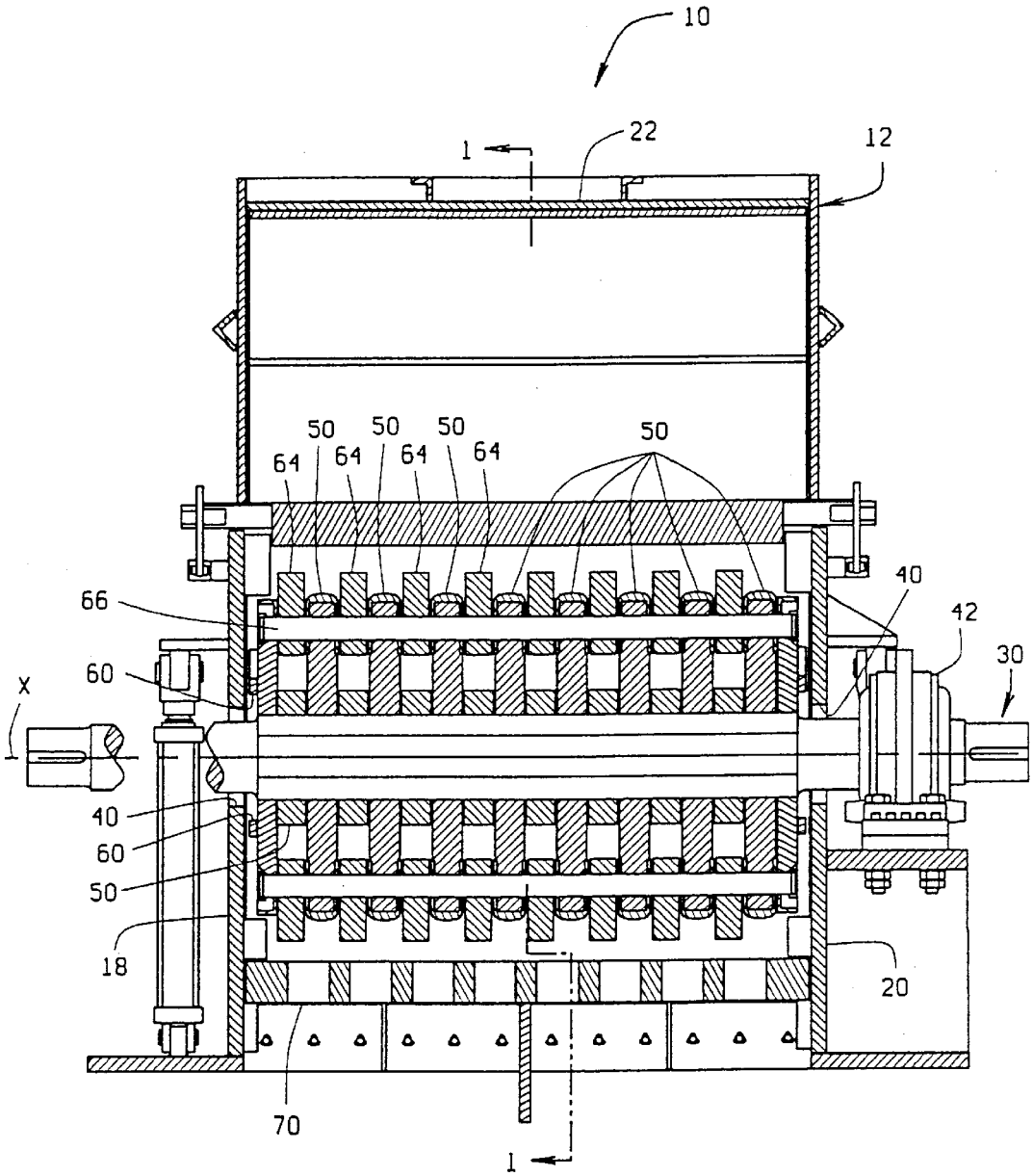
FIG. 2 is a cross-sectional view of the crusher taken along line 2—2 of FIG. 1.

A crusher 10 is shown generally in FIGS. 1 and 2. The crusher 10 includes a housing 12 having a front wall 14, a back wall 16, side walls 18 and 20, and a top 22. A feed inlet 24 is formed in the front wall, and, can extend only a portion of the side-to-side width of the crusher 10, or can extend substantially the full side-to-side width of the crusher 10.

Figure 3:
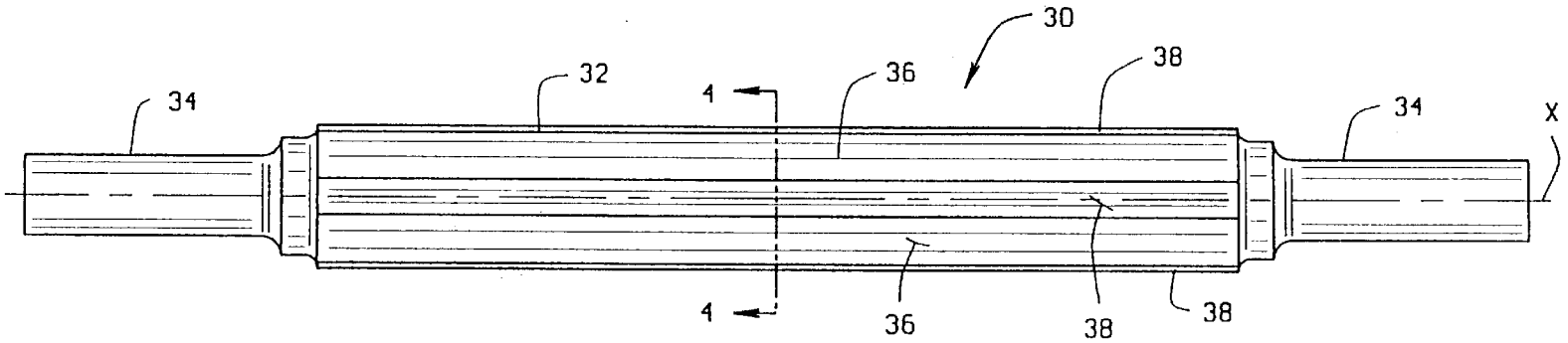
FIG. 3 is a side elevational view of the shaft.
Figure 4:
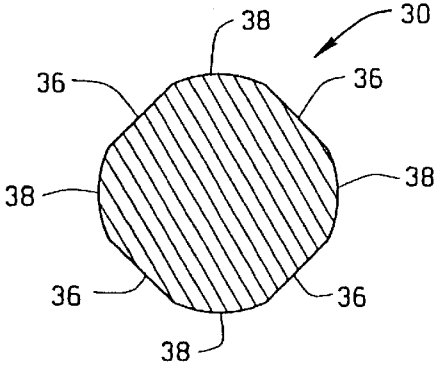
FIG. 4 is a cross-sectional view of the shaft taken along line 3—3 of FIG. 4.

A rotor or shaft 30 extends between the side walls 18 and 20 to rotate within the housing. As seen in FIG. 3, the rotor 30 includes a multi-sided central section 32 and two cylindrical end sections 34 extending from opposite sides of the central section. As seen in FIG. 4, the central section 32 has eight sides; however, it could be formed with fewer sides or more sides, as desired. The central section 32 as shown in FIG. 4 includes four long sides 36 which are angled generally 90° to each other and four short sides 38 positioned between the long sides 36, and which are also angled generally 90° to each other. The short sides 38 are curved and define arcs of a circle. Thus, in cross-section, the rotor central section 32 can be defined as a circle which is flattened along four sides to form the long sides 36. Alternatively, the central section 32 can be defined as a square in which the corners are truncated or beveled; the beveled or truncated sections forming the curved short sides 38. The ends 34 of the rotor 30 extend through openings 40 in the side walls 18 and 20. At least one end of the rotor 30 is in a bearing assembly 42, to allow the rotor to rotate within the housing 12. The other end 34 of the rotor 30 can be operatively connected to, and supported by, a drive, such as a motor to rotate the shaft along its axis X.

Figure 5:
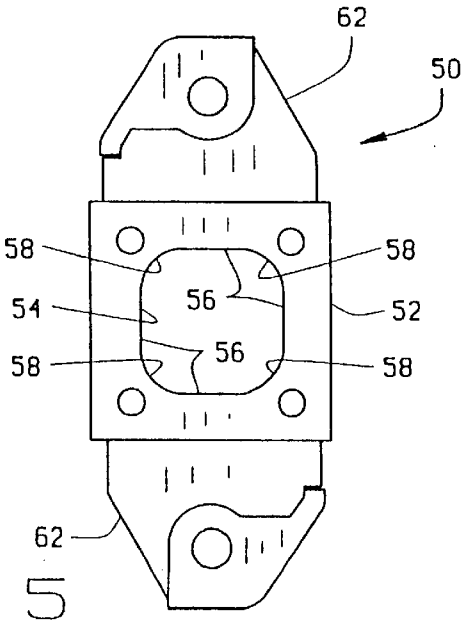
FIG. 5 is a plan view of a spider which is mounted on the shaft to support hammers in the crusher.

A plurality of spider arms 50 are positioned on the rotor central section 32. The spiders have a generally square base 52 having with a central opening 54. The opening 54 is a generally square opening having straight sides 56 and curved, rather than sharp, corners 58. The square opening 54 of the spider arm is sized to fit over the rotor central section, such that the central section long sides 34 are adjacent the straight sides of the square opening 54. Rods 60 extend transversely through the spider bases 52 to hold the spider arms 50 together on the rotor 30. See FIG. 5. A pair of arms or mounts 62 extends from opposite sides of each spider base. The arms 62 of adjacent spiders alternate, such that one set is vertical, the next is horizontal, the next is vertical, etc. Hammers 64 are mounted between adjacent spiders which extend in the same direction. A hammer shaft 66 extends through the arms 62, and the hammers 64 are journaled on the hammer shafts 66. As can be appreciated, the hammers are positioned at intervals of 90° around the circumference of the rotor shaft 30. The rotor shaft could be provided with more than two pair of opposing straight sides to reduce the interval between the hammers. For example, if the rotor shaft had three pair of opposing straight sides, the hammers could be spaced at intervals of 60° around the shaft. Four pair of opposing straight sides would allow for intervals of 45° between the hammers. Alternatively, the rotor shaft could be formed with only one pair of opposing straight sides, such that the hammers are positioned 180° apart from each other. This would require the use of spacers between the spider arm bases.

A grate 70 extends from the bottom of the inlet 24 beneath and around the rotor 30 and hammers 64 in a generally arcuate fashion. The grate 70, as can be appreciated, will hold matter to be crushed in the housing to be impacted and crushed the hammers. As the material is crushed to a desired size, it will fall through the grate 70.

The use of the multi-sided rotor shaft 30 facilitates assembly of the spider arms 52 and hammers 64 on to the rotor 30, as well as operation of the crusher 10. Because the shaft 30 includes the flat sides 36, and the spider base openings 54 have the corresponding flat sides 56, the spiders 50 cannot rotate relative to the rotor shaft 30. Thus, the crusher 10 does not require keys and keyways, pins, bolts, or other fasteners to rotationally fix the spider arms 52 to the rotor shaft central section 32. Additionally, the corresponding shape of the rotor shaft central section 32 to the spider openings 54 causes the rotor shaft 30 to positively drive the spiders, and hence the hammers. Again, because there are no keys and keyways, pin, bolts or other fasteners which secure the spiders to the rotor shaft 30, there are no keys and keyways, pins, bolts, or fasteners which might sheer during operation. Hence, the use of the multi-sided rotor shaft 30, with the spider arms having straight side walls reduces not only the construction costs of the crusher or mill 10, but also reduces maintenance costs of the crusher or mill 10.

As various changes could be made in the above constructions without departing from the scope of the invention, it is intended that all matter contained in the above description or shown in the accompanying drawings shall be interpreted as illustrative and not in a limiting sense.

What is claimed is:

1. Crusher machinery in the category of a shredder, crusher, hammer mill or ring mill, and for use for crushing material, said crusher machinery comprising a shaft, a housing with support structure for holding said shaft in position for rotation therein, said shaft being multi-sided, said multi-sided shaft having four equally spaced substantially flattened surfaces integrally formed into a square shaft substantially along its length, said shaft holding at least one support spider thereon, said at least one support spider having a spider base, said spider base having an opening therein which is also square, and having a size greater than the four flattened surfaces of the square shaft so as to be accommodated thereon, a pair of spider arms, one of each spider arm extending from opposite sides of said spider base and being connected thereto, a series of rods extending transversely through the spider arms and said rods provided for folding a hammer to each of the spider arms during usage, there being integral extensions provided projecting from either end of the square shaft, said extensions being circular in configuration and provided for mounting said square shaft within the support structure of the machinery, an arcuate grate provided beneath the square shaft and its mounted spider base, spider arms, and hammers, said grate provided for holding any material to be crushed in the housing when impacted during usage of the crusher machinery.

2. The crusher machinery of claim 1 wherein each spider base has said opening provided approximately centrally therethrough, said opening being square in configuration, and which square opening has a configuration substantially similar to but slightly larger than the square shape of the multi-sided shaft for the crusher machinery.

3. The crusher machinery of claim 2 wherein said extensions being of a lesser diameter than the distance between any pair of oppositely disposed flattened surfaces integrally formed upon the square shaft.

* * * * *